US008191484B2

(12) United States Patent
Lohmann et al.

(10) Patent No.: US 8,191,484 B2
(45) Date of Patent: Jun. 5, 2012

(54) ROTATION IMPEDING DEVICE FOR A VEHICLE

(75) Inventors: Alfred Lohmann, Siegen-Eisern (DE); Michael Wusching, Wilthen (DE)

(73) Assignee: Bombardier Transportation GmbH, Berlin (DE)

( * ) Notice: Subject to any disclaimer, the term of this patent is extended or adjusted under 35 U.S.C. 154(b) by 290 days.

(21) Appl. No.: 12/548,096

(22) Filed: Aug. 26, 2009

(65) Prior Publication Data

US 2010/0107922 A1 May 6, 2010

(30) Foreign Application Priority Data

Aug. 27, 2008 (DE) ..... 10 2008 039 821

(51) Int. Cl.
*B61F 3/00* (2006.01)

(52) U.S. Cl. ..... 105/193; 105/199.3

(58) Field of Classification Search ..... 105/157.1, 105/182.1, 199.1, 199.3, 193
See application file for complete search history.

(56) References Cited

U.S. PATENT DOCUMENTS

| | | | | |
|---|---|---|---|---|
| 2,698,208 | A * | 12/1954 | Dilg | 384/423 |
| 3,730,104 | A * | 5/1973 | Hood, II | 105/199.3 |
| 3,889,607 | A * | 6/1975 | Hassenauer | 105/199.2 |
| 4,080,016 | A * | 3/1978 | Wiebe | 384/423 |
| 4,228,741 | A * | 10/1980 | Bruner | 105/198.3 |
| 5,351,624 | A * | 10/1994 | Ahlborn et al. | 105/185 |
| 5,386,783 | A * | 2/1995 | Rhen et al. | 105/199.3 |
| 5,454,330 | A * | 10/1995 | Rhen | 105/199.3 |
| 5,682,822 | A * | 11/1997 | Sunderman et al. | 105/199.3 |
| 5,960,719 | A * | 10/1999 | Sunderman et al. | 105/199.3 |
| 6,279,488 | B1 * | 8/2001 | Hachmann et al. | 105/453 |
| 6,581,527 | B2 * | 6/2003 | Hewitt | 105/199.3 |
| 2002/0104459 | A1 * | 8/2002 | Hewitt | 105/199.3 |
| 2007/0022900 | A1 * | 2/2007 | O'Donnell et al. | 105/199.3 |
| 2008/0210119 | A1 * | 9/2008 | Lehmair et al. | 105/199.3 |
| 2009/0308276 | A1 * | 12/2009 | Aitken et al. | 105/199.3 |
| 2010/0107922 | A1 * | 5/2010 | Lohmann et al. | 105/193 |

FOREIGN PATENT DOCUMENTS

| | | | |
|---|---|---|---|
| DE | 4122741 | A1 | 1/1993 |
| EP | 0004585 | A1 | 10/1979 |
| FR | 2217198 | | 9/1974 |
| GB | 2402374 | A | 12/2004 |
| WO | 9301076 | A1 | 1/1993 |
| WO | 2007096655 | A1 | 8/2007 |

* cited by examiner

*Primary Examiner* — S. Joseph Morano
*Assistant Examiner* — Jason C Smith
(74) *Attorney, Agent, or Firm* — The Webb Law Firm

(57) ABSTRACT

A rotation impeding device for a vehicle having a first vehicle component comprising a running gear and a second vehicle component comprising a wagon body supported thereon the rotation impeding device comprising a friction element carrier for a first friction element, wherein the friction element carrier is connectable to the running gear or the wagon body in such a manner torsionally rigid about a height axis of the vehicle that the wagon body is supported on the running gear by means of the friction element, wherein the wagon body is rotatable relative to the running gear under a friction-laden relative movement between the first friction element and a second friction element impeding a rotation about the height axis. There is provided a force generating device with a contact element, wherein the force generating device is connectable to the vehicle component carrying the friction element carrier in such a way that it acts, via the contact element, on the friction element carrier in order to generate a contact force between the first friction element and the second friction element.

22 Claims, 3 Drawing Sheets

ROTATION IMPEDING DEVICE FOR A VEHICLE

Figure 1:
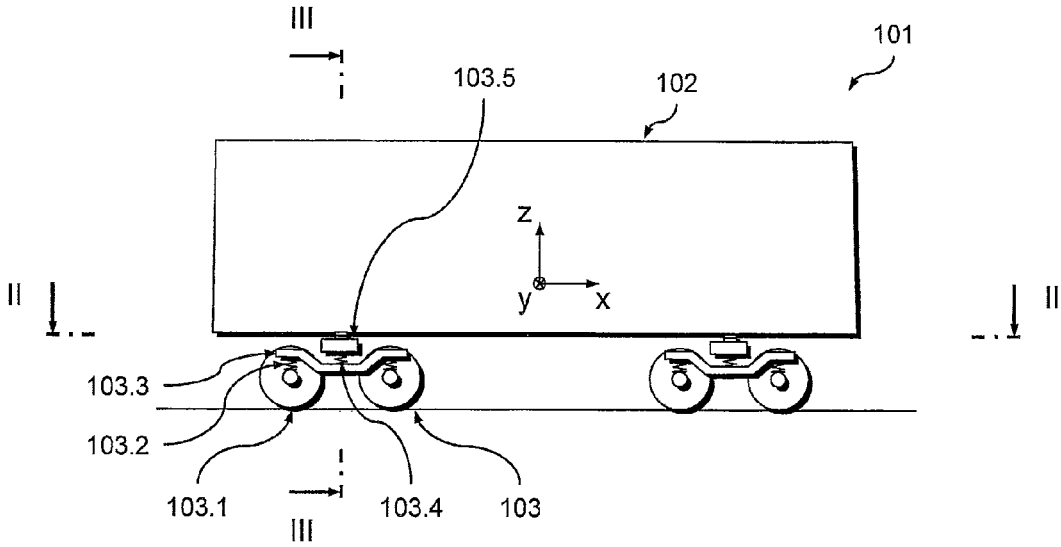

The present invention relates to a rotation impeding device for a vehicle, in particular a rail vehicle, with a running gear assembly as a first vehicle component and a wagon body supported on this as a second vehicle component. The rotation impeding device comprises a friction element carrier for a first friction element, wherein the friction element carrier is designed in such a way as to be connected to the running gear or wagon body in a manner torsionally rigid about a height axis of the vehicle, such that the wagon body is supported on the running gear by means of the first friction element. The wagon body is in this situation capable of rotating relative to the running gear by way of a friction-laden relative movement between the first friction element and a second friction element, impeding a rotation about the height axis.

With conventional rail vehicles, with a wagon body supported on a running gear and rotatable about a height axis of the vehicle, the principle is known, among others, of imposing a damping resistance against the rotation of the running gear (about the height axis of the vehicle) in relation to the wagon body by means of a rotation impeding device, such as is known, for example, from WO 93/01076 A1, in particular for keeping the lurching of the vehicle within specified limits when travelling in a straight line. The axis of rotation for this rotational movement is in most cases defined by a swivel pin, by means of which the wagon body is connected to the running gear.

Typically, this is put into effect by means of separate damper elements (referred to as lurching dampers) and/or what is referred to as friction rotation impedion between the running gear and the wagon body. With friction rotation impedion, a friction pairing is provided between a first friction element secured to the running gear and a second friction element at the wagon body. If the running gear rotates in relation to the wagon body, a friction-laden relative movement occurs between the first friction element and the second friction element, which imposes a damping resistance against the rotation and therefore impedes the rotation.

With the vehicle known from WO 93/01076 A1, the first friction element is secured directly to a bolster sitting via a secondary suspension unit on a running gear frame, while the second With the vehicle known from WO 93/01076 A1, the first friction element is secured directly to a bolster sitting via a secondary suspension unit on a running gear frame, while the second friction element is secured directly to the wagon body structure. This rigid connection of the friction elements to the running gear and wagon body respectively has the disadvantage that in certain travel situations there may be a non-uniform contact force between the friction elements leading to an undesirable irregular damping of the rotational movement.

From EP 0 004 585 A1 a generic rotation impeding device is known, wherein the first friction element is mounted to a friction element carrier in the form of a leaf spring designed in the manner of a bow along its longitudinal direction. The leaf spring is connected to the running gear at one end by means of a rotating link (torsionally rigid about the height axis), while at the other end it is located in a displaceable manner (in its longitudinal direction) in a guide on the running gear. The middle part of the leaf spring, cambered towards the wagon body, forms the first friction element, such that the leaf spring deflects when the wagon body is set onto the running gear, and is therefore set under pre-tension. Accordingly, the first friction element can follow relative movements between the wagon body and the running gear in the direction of the height axis, such that in such cases as well a certain contact force is achieved between the friction elements and therefore a certain damping of the rotational movement.

One problem with this generic rotation impeding device, however, lies in the fact that it requires a comparatively large amount of construction space, since in order to produce a high contact force and therefore a high friction moment about the height axis (i.e. a good damping effect on the rotational movement) with adequate spring travel in the direction of the height axis, a comparatively long leaf spring is required. This has the consequence that the distance (transverse to the height axis) between the axis of rotation of the rotational movement and the two friction elements becomes comparatively small, as therefore too does the friction moment, since, due to the limited structural space in the area of the running gear, a long leaf spring of this type can usually only be arranged with its longitudinal axis aligned in the transverse direction of the vehicle.

A further disadvantage of the rotation impeding device from EP 0 004 585 A1 lies in the fact that the jointed connection of the leaf spring typically exhibits a certain degree of play in relation to the torsionally rigid connection about the height axis, which delays the onset of the damping effect in the event of a reversal of the rotational movement.

A further disadvantage of the rotation impeding device from EP 0 004 585 A1 lies in the fact that the leaf spring in the normal operation of the vehicle (in particular under different loading circumstances) carries out an excursion movement between two extreme positions, as a result of which a comparatively pronounced variation in the force exerted by the leaf spring occurs, such that the rotational movement depends largely on the actual loading of the vehicle. Thus, when the wagon body is subjected to high loading, an undesirably sharp rise in the damping effect occurs, which has a disadvantageous effect on travel comfort.

The present invention is therefore based on the object of providing a rotation impeding device of the type referred to in the preamble which does not exhibit the disadvantages referred to heretofore, or at least to a significantly lesser degree, and, in particular, with simple and economical manufacture, under different operating conditions makes possible a permanent damping effect, as uniform and high as possible over the entire movement sequence, on the rotational movement of the running gear in relation to the wagon body.

The present invention resolves this object, starting from a rotation impeding device according to the preamble to Claim 1, by way of the features indicated in the characterizing part of Claim 1.

The present invention is based on the technical teaching that, with simple and economical manufacture, under different operating conditions, a permanent damping effect, as uniform and high as possible over the entire movement sequence, can be achieved on the rotational movement of the running gear in relation to the wagon body, if a force generating device with a contact element is provided which acts on the friction element carrier and, thus, creates a variable contact force between the first friction element and the second friction element.

Due to the functional separation of the friction element carrier and the force generating device, it is possible on the one hand, with a view to the attainment of a high friction moment damping the rotating movement, for the first friction element to be arranged at a favourable position far remote from the axis of rotation of the rotational movement. A further advantage lies in the fact that the force generating device can be optimised in a simple manner for its primary function of providing a force, while the friction element carrier itself can in turn be easily optimised with regard to its primary function of the most play-free possible introduction of the damping friction moment into the vehicle component connected to it. A further advantage of this design lies, in particular, in the fact that the force generating device can be designed in a simple manner such that, regardless of the loading of the vehicle, the most uniform possible contact force takes effect between the friction elements, such that a damping effect on the rotational movement is attained which is as independent as possible of the loading of the vehicle.

Thus, according to one aspect of the invention, it relates to a rotation impeding device for a vehicle, in particular a rail vehicle, with a running gear assembly as a first vehicle component and a wagon body supported thereon as a second vehicle component, comprising a friction element carrier for a first friction element. The friction element carrier is designed to be connected to the running gear or the wagon body in a manner torsionally rigid about a height axis of the vehicle such that the wagon body is supported on the running gear via the first friction element, wherein the wagon body is rotatable relative to the running gear under a friction-laden relative movement between the first friction element and a second friction element impeding a rotation about the height axis. In addition, a force generating device with a contact element is provided, wherein the force generating element is connectable to the vehicle component carrying the friction element carrier in such a way that it acts, via the contact element, on the friction element carrier to exert a contact force between the first friction element and the second friction element.

It should be again explicitly noted at this point that the friction element carrier can be connected in a torsionally rigid manner to, both, the running gear as well as (with other variants) to the wagon body. In particular, an embodiment which initially is provided for being secured to the running gear can be used, if appropriate, by simple rotation through 180° (about a horizontal axis), in an embodiment wherein securing to the wagon body is provided. This provides the advantage of very high flexibility using the rotation impeding device according to the invention.

The force generating device can in principle be designed in any desired manner. For example, it may be provided that the contact element adopts a different position for every value of the contact force between the two friction elements. This can be the case, for example, if the force generating device is formed as a simple spring device, which is placed between the assigned vehicle component and the friction element carrier.

With particularly advantageous variants of the rotation impeding device according to the invention, it is provided that the force generating device defines a break-loose force, the exceeding of which causes a deflection of the contact element. This makes it possible to achieve the situation in which, in the first instance, a loading-dependent rise in the friction moment is incurred, up to a specific loading of the wagon body and up to a specific friction moment threshold, which is derived when the break-loose force is reached. Above this friction moment threshold, it is possible to achieve, as a result of the deflection of the contact element (dependent on the characteristic line of the force generating device), a flatter rise in the friction moment up to an at least almost constant course of the friction moment. Thus, in other words, it is possible, in an advantageous manner, to achieve a delimitation of the friction moment and, therefore, of the damping of the rotating movement above a specific predeterminable loading of the wagon body.

In this situation, the value of the break-loose force can be specifically predetermined by the dimensioning of the force generating device. Preferably, however, the force generating device exhibits a pre-tensioning device for the adjustment of the break-loose force, in order to achieve in this way, in an advantageous manner, a setting of the load-dependent curve of the friction moment, as appropriate, and therefore of the damping of the rotational movement, which is matched to the individual case.

The force generating device can in principle be designed in any desired manner, in particular such that its force effect is achieved in accordance with an arbitrary working principle. Thus, for example, it may work according to a hydraulic or pneumatic working principle. Thanks to the particularly simple and low-maintenance structure, however, preference is given to the force generating device operating according to a mechanical working principle.

In addition, the force generating device may be an active device with one or more active components, with which the force effect is adjusted by means of an appropriate actuation arrangement. Thanks to the simple and robust structure, however, the force generating device preferably comprises a passive device, in particular a simple spring device, for generating a contact force.

The spring device can in principle be designed in any suitable manner. Thus, for example, a simple pneumatic spring can be provided. Likewise, a simple mechanical spring, such as a helical spring or the like, can be provided. For preference the spring device comprises at least one disk spring and a disk spring guide, wherein the disk spring defines a main spring direction in which the disk spring exerts its main spring force, and the disk spring guide guides the disk spring transversely to the main spring direction. With such disk springs it is possible in a particularly simple manner for a desired force curve to be achieved for the force generating device in a particularly small structural space.

Provision can be made in this situation that the force of the force generating device defined by the at least one disk spring is exerted onto the friction element carrier by means of a separate contact element. With particularly simply designed variants of the rotation impeding device according to the invention, however, provision is made that the at least one disk spring itself forms the contact element.

As mentioned, the force generating device preferably is designed in such a way that (if appropriate, above a predeterminable threshold) a variation in the loading of the wagon body incurs only a slight variation in the contact force between the first friction element and the second friction element, and therefore only a slight variation in the damping friction moment. For this purpose the force generating device preferably is designed in such a way that the contact element, in normal operation of the vehicle, carries out a predeterminable excursion between a first extreme position and a second extreme position, wherein the contact element in the first extreme position exerts a first force (maximum force, if applicable) onto the friction element carrier and in the second extreme position exerts a second force on the friction element carrier. The second force can in this situation deviate from the first force by up to 30% of the first force. For preference in this case the second force deviates from the first force by a maximum of 20% of the first force, preferably a maximum of 10% of the first force, and for further preference a maximum of 5% of the first force.

As a result of this, from the viewpoint of running dynamics a particularly favourable curve of the damping friction moment can be attained. The damping friction moment is then (if appropriate, above a predeterminable threshold) not only largely load-independent, but, even under the effect of vertical inertia forces, which with known designs incur a sharp variation in the friction moment, the friction moment remains in an advantageous manner within narrow predeterminable limits.

The contact element can engage at any desired point on the friction element carrier. For example, the contact element can take effect on the friction element carrier in the area of the first friction element. With other variants of the invention, the contact element can, however, also take effect on the friction element carrier on a side facing away from the first friction element.

The friction element carrier can in principle be designed in any suitable desired manner from one or more components. For preference the friction element carrier is designed as a simple structural unit, which exhibits at least one carrier arm with a first end area and a second end area located at a distance in the direction of a longitudinal axis of the carrier arm. In the first end area, the carrier arm exhibits a connection area, which is designed to form the connection with the vehicle component carrying the friction element carrier. In an area located at a distance from the first end area in the direction of the longitudinal axis of the carrier arm, the carrier arm then carries the first friction element.

The carrier arm can in principle be designed in any suitable manner. For example, it can be designed as a simple narrow component (in comparison with its longitudinal extension), which is connected to the vehicle component carrying the friction element carrier at one or more connection sections located at a distance from one another along its longitudinal axis. For preference, however, provision is made for the connection area of the carrier arm to exhibit at least two connection sections, which are designed to provide the connection with the vehicle component carrying the friction element carrier, wherein the two connection sections are located at a distance from one another transverse to the longitudinal axis of the friction element carrier. As a result, a support can be achieved for the friction moment on the vehicle component carrying the friction element carrier which is particularly advantageous (in particular with regard to the most play-free possible introduction of the friction moment).

For preference, at least one of the connection sections is designed such as to be connected free of play to the vehicle component carrying the friction element carrier, in order to guarantee at any time (i.e. also in the event of a reversal of direction of the rotational movement) the introduction of the desired friction moment. This can be effected by means of an appropriate joint. Due to the particularly simple design, however, a rigid connection is provided for preference in this connection section. The friction element carrier is then for preference designed to be correspondingly soft in the direction of the height axis, in order to be able to follow relative movements between the running gear and the wagon body. In a plane perpendicular to the height axis, however, the friction element carrier is for preference adequately stiff in order to guarantee at any time (i.e. also in the event of a reversal of direction of the rotational movement) the introduction of the desired friction moment.

This can in principle take place in any desired manner, for example in that the carrier arm is designed essentially as plate shaped, wherein the plane of the plate (hence the plane of main extension of the friction element carrier) runs transverse to the height axis. The outer contour of the plate-shaped carrier arm can then be designed in any desired manner. For preference the carrier arm is designed to be essentially triangular, since this achieves a design adapted to the actual load circumstances in a particularly simple manner.

Accordingly, for example, provision is made for preference for the connection area to extend between two corner areas of the carrier arm, and the friction element to be arranged in the third corner area of the carrier arm. Such a configuration takes particularly effective account of the load relationships in the introduction of the friction moment into the vehicle component carrying the carrier arm, since, on the one hand, the bending moment about the height axis is still comparatively low at the apex of the triangle with the friction element, such that the small cross-section of the carrier arm is sufficient to bear this. With this design, as the bending moment increases towards the connection area, the cross-section also increases, such that, on the one hand, an optimum utilisation of the cross-section of the carrier arm can be achieved. On the other hand, a high support width in the connection area can be achieved, as a result of which the loads introduced into the load-bearing vehicle component are reduced and the connection in the connection area can be designed correspondingly simple.

It is understood in this respect that the essentially triangular design form of the carrier arm need not necessarily exhibit straight sides. Rather, with preferred variants of the invention provision is made for a contour of the sides which is, at least section-wise, polygonal and/or cambered.

For preference, with the design of the carrier arm account is taken not only of the curve of the bending moment about the height axis, resulting from the friction moment. Rather, account can also be taken of a compensatory deformation of the carrier arm required due to relative movements between the running gear and the wagon body. Accordingly, the bending resistance moment of the carrier arm, about the bending axis to be taken into account, can be selected in each case in such a way that the carrier arm, when in actual operation and with the loads to be expected, does not undergo any deformation worth mentioning about one bending axis (e.g. the height axis), while it undergoes a desired deformation about another bending axis (e.g. running transverse to the height axis and the longitudinal axis of the carrier arm).

The corresponding variation in the bending resistance moment can be effected in any desired suitable manner, namely by means of the material and/or the cross-section geometry. With preferred variants of the invention, the carrier arm exhibits an area moment of inertia about an axis of inertia, wherein the axis of inertia runs transverse to a plane defined by the longitudinal axis of the carrier arm and the height axis of the vehicle, and provision is made for the area moment of inertia to vary in normal operation in the direction of the longitudinal axis of the carrier arm according to a desired deformation of the carrier arm, in particular by decreasing towards the second end. In this situation, the desired deformation can be adapted to any preferred conditions. For preference in this context this relates to conditions in respect of the connection of the carrier arm to the load-bearing vehicle component and/or the introduction of the loads into the load-bearing vehicle component.

With advantageous variants of the rotation impeding device, the area moment of inertia is varied in such a way that a deformation of the carrier arm which is to be expected in normal operation of the vehicle essentially does not extend as far as into the connection area. As a result, the connection of the carrier arm can be of particularly simple design. The carrier arm exhibits a cross-section, in a cross-section plane running transverse to its longitudinal axis, wherein the cross-section of the carrier arm, as a variation of the area moment of inertia, decreases in the direction of the longitudinal axis of the carrier arm.

The present invention further relates to a vehicle, in particular a rail vehicle, with a running gear, a wagon body supported thereon, and a rotation impeding device according to the invention, wherein the friction element carrier is connected to the running gear or the wagon body in a manner torsionally rigid about a height axis of the vehicle, such that the wagon body is supported on the running gear by way of the first friction element. The wagon body can be rotated relative to the running gear, wherein a friction-laden relative movement impeding a rotation about the height axis occurs between the first friction element and a second friction element, and the force generating device is connected to the vehicle component carrying the friction element carrier.

For preference, the friction element carrier and the force generating device are connected to the running gear, since such a design is particularly easy to realise. The running gear can be designed in any desired manner, wherein it is of particular advantage if the running gear comprises a running gear frame and a bolster, which is supported by means of a secondary suspension on the running gear frame, and runs in the transverse direction of the vehicle, the wagon body is supported on the bolster by means of the rotation impeding device, and the rotation impeding device is arranged in an end area of the bolster. As a result of this, a simple and effective integration of the rotation impeding device can be attained. For preference, in this situation the friction element carrier and the force generating device are connected to the bolster.

The present invention can be applied in connection with any desired support of the wagon body on the running gear. For example, it can be used with variants with which the wagon body is supported in the direction of the height axis only by means of the friction elements, while longitudinal and transverse forces are transferred between wagon body and running gear by means of a swivel pin or the like. With particular advantage, however, it can also be applied to vehicles with which the wagon body is supported on the wagon body in the direction of the height axis by means of a bearing device defining the axis of rotation of the relative movement between the wagon body and the running gear, such as a slewing ring or the like.

Figure 2:
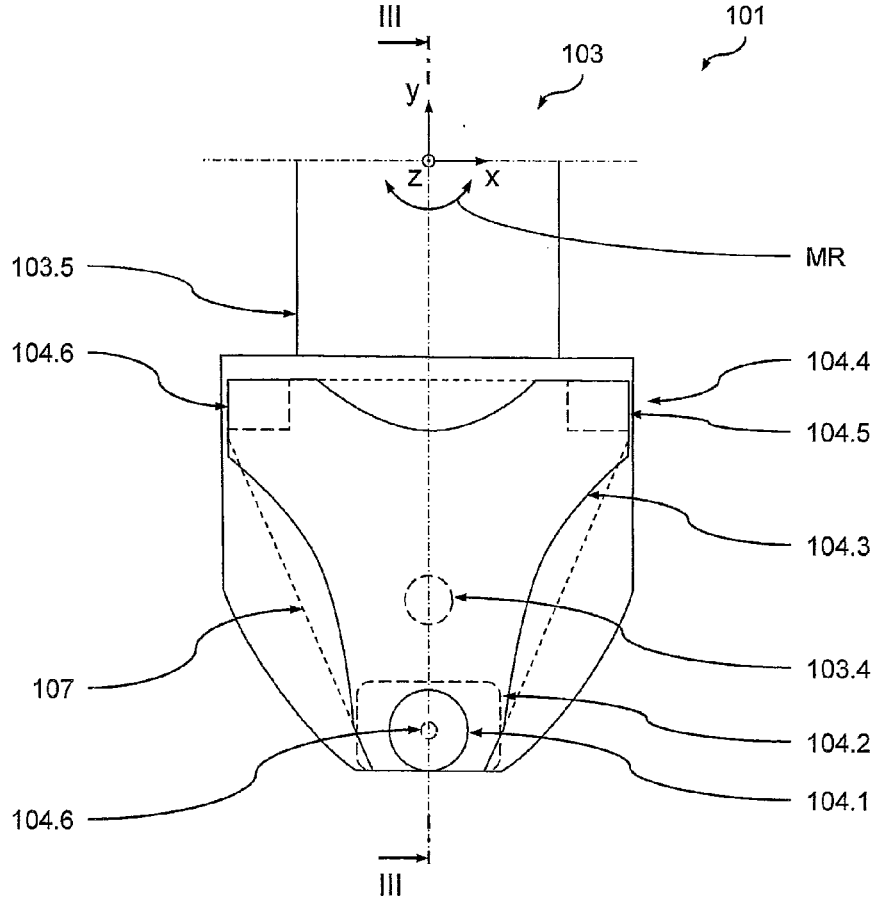
Figure 3:
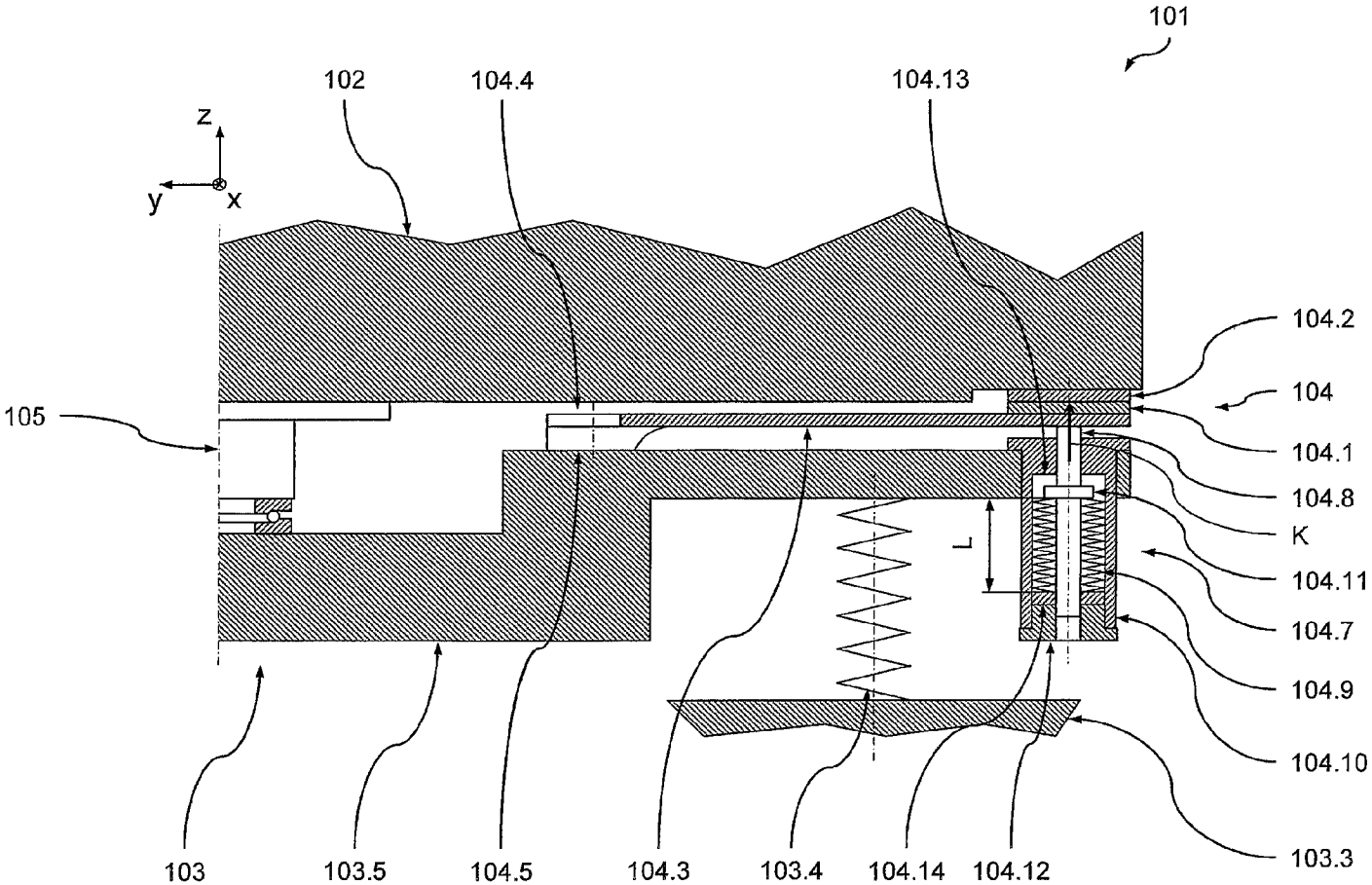
Figure 4:
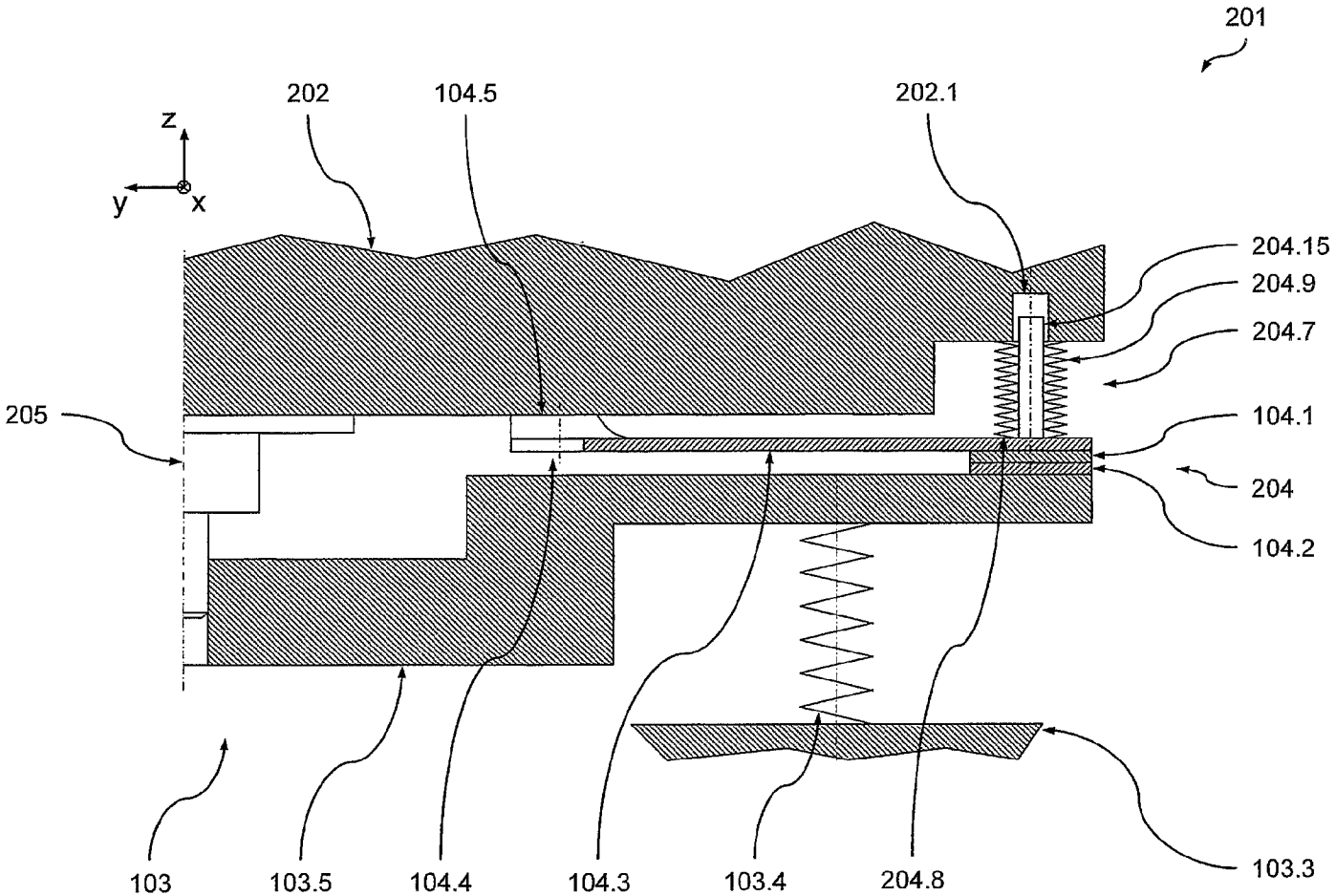

Further preferred embodiments of the invention become apparent from the dependent claims and the following description, respectively, which refers to the appended drawings. It is shown in:

FIG. 1 a schematic side view of a preferred embodiment of the rail vehicle according to the invention, with a preferred embodiment of the rotation impeding device according to the invention;

FIG. 2 a detail of the rail vehicle from FIG. 1 in a schematic section along the line II-II;

FIG. 3 a detail of the rail vehicle from FIG. 1 in a schematic section along the line III-III;

FIG. 4 a diagrammatic section through a detail of a further preferred embodiment of the rail vehicle according to the invention, with a further preferred embodiment of the rotation impeding device according to the invention.

FIRST EMBODIMENT

FIGS. 1 to 3 show schematic representations of a rail vehicle 101 according to the invention. To simplify the following description, use is made in the figures of a co-ordinate system (x, y, z), with which the x-axis designates the longitudinal direction of the vehicle, the y-axis the transverse direction of the vehicle, and the z-axis the height direction of the vehicle. It may be noted here that the details given hereinafter regarding the alignment or position of individual components of the vehicle (unless expressly specified otherwise) refer in all cases to a static state with a straight horizontal track arrangement.

The rail vehicle 101 comprises a wagon body 102, which is supported in the area of both its ends on a running gear in the form of a bogie 103. The bogie 103 comprises in each case two wheel sets 103.1, on which a bogie frame 103.3 is supported by means of a primary suspension unit 103.2 (only represented in highly diagrammatic form in the figures). Supported in turn on the bogie frame 103.3 in a conventional manner by means of a secondary suspension unit 103.4 (only represented in highly diagrammatic form in the figures), is a bolster 103.5.

In the area of both ends of the bolster 103.5, lying in the transverse direction of the vehicle, the wagon body 102 is supported on the bolster 103.5 in each case by means of the friction elements 104.1 and 104.2 of a rotation impeding device 104 according to the invention. The wagon body 102 is further supported on the bolster 103.5, in the middle area of the bolster 103.5, by means of a support device 105, designed in the manner of a slewing ring, such that a distribution of the support forces (in the vertical direction of the vehicle) is effected between the support device 105, arranged in the middle, and the rotation impeding devices 104.

As can be seen from FIGS. 2 and 3, the rotation impeding device 104 comprises a friction element carrier 104.3, secured to the bolster 103.5, which carries the first friction element 104.1. The friction element carrier 104.3 in this situation is designed as an essentially triangular carrier arm, the longitudinal axis of which extends in the transverse direction of the vehicle.

At one end of the carrier arm 104.3, a connection area 104.4 is formed in a first end area of the carrier arm 104.3 (forming the basis of the carrier arm 104.3). The connection arm 104.4 exhibits (at two corners, namely the two ends of the basis of the carrier arm 104.3) two connection sections 104.5 and 104.6, located at a distance between each other in the longitudinal direction of the vehicle (x-direction), by means of which the carrier arm 104.3 is connected to the bolster 103.5.

At the second end area of the carrier arm 104.3, at a distance from the first end area in the transverse direction of the vehicle (y-direction), the first friction element 104.1 is arranged on the upper side of the carrier arm 104.3 facing the wagon body 102. The first friction element 104.1 can in this situation be secured to the carrier arm 104.3 in a detachable manner, in order to guarantee the possibility of rapid replacement of the first friction element 104.1. The first friction element 104.1 interacts with the second friction element 104.2, which is likewise secured to the wagon body 102 in a detachable manner, in order to guarantee the possibility of rapid and easy replacement.

Arranged in the second end area of the carrier arm 104.3 is a separate force generating device 104.7 of the rotation impeding device 104. The force generating device takes effect on the side of the carrier arm 104.3 facing away from the first friction element 104.1 via a contact element 104.8, and so creates a contact force F between the first friction element 104.1 and the second friction element 104.2.

In the event of a rotational movement of the bogie 103 in relation to the wagon body 102 about the height axis of the vehicle (z-direction), a friction-laden relative movement is incurred between the two friction elements 104.1 and 104.2, which causes a friction moment MR about the height axis of the vehicle. This friction moment counteracts the rotational movement in each case and so dampens the rotational movement of the bogie 103 in relation to the wagon body 102. The amount of the contact force F in this situation determines the amount of the friction moment MR.

In order to be able to influence the friction moment MR, the force generating device 104.7 exhibits a mechanical spring device in the form of a disk spring package 104.9, which is arranged in a cylindrical chamber of a housing 104.10 (guiding the individual disk springs transverse to their main spring direction) of the force generating device 104.7. The disk spring package 104.9, on the one hand, is supported against a ring-shaped shoulder 104.11 at the contact element 104.8 and, on the other hand, against the housing cover 104.12 of the housing 104.10. The housing 104.10 is rigidly connected to the bolster 103.5, such that the contact element 104.8 protruding through the housing 104.10 is pressed by the spring force of the disk spring package 104.9 (in its main spring direction) upwards against the carrier arm 104.3, as a result of which the contact force K is generated.

The contact force K is determined in this situation from the current axial length L of the disk spring package 104.9. The shorter the axial length L is in the current state, the more strongly the disk spring package 104.9 is compressed, and the greater is the force exerted by the disk spring package 104.9.

In the unladen state of the force generating device 104.7, the shoulder 104.11 is pressed by the force effect of the disk spring package 104.9 against an upper stop 104.13 at the housing 104.10. For preference, provision is made for the disk spring package 104.9 to be compressed already by a certain length, in other words is pre-tensioned by a certain amount in comparison with a load-free state. The shoulder 104.11 is then in contact at the stop 104.13 under a certain pre-tension force FV.

The amount of the pre-tension force FV in the present example can be adjusted within broad limits by means of a pre-tension device, depending on the requirements of the particular present situation. The pre-tensioning device is in this situation formed by the housing cover 104.12 connected in a detachable manner to the housing 104.10 and, as appropriate, by one of the several replaceable spacer disks 104.14. Depending on the thickness (dimension in the longitudinal direction of the disk spring package 104.9) of the spacer disk(s) 104.14 used, the disk spring package 104.9 in the unladen state of the force generating device 104.7 is more or less strongly compressed, and the shoulder 104.11 is therefore more or less strongly pre-tensioned against the stop 104.13.

The design with the detachable housing cover 104.12 further has the advantage that the force generating device can be taken out of operation, for example for maintenance purposes, by removing the housing cover 104.12. This then makes it possible, in a simple manner, to replace the friction elements 104.1 and 104.2, or the entire carrier arm 104.3 respectively.

If the contact element 104.8 is subjected to load by the wagon body 102 sitting on the bolster 103.5, then initially no deflection of the contact element 104.8 is effected until a force is exerted on the contact element 104.8 by the carrier arm 104.3 in the longitudinal direction of the disk spring package 104.9 which is greater than the pre-tension force FV. In other words, the pre-tension force FV defines a break-loose force exceeding of which causes a deflection of the contact element 104.8.

If a further increase is effected in the force exerted by the carrier arm 104.3 in the longitudinal direction of the disk spring package 104.9 onto the contact element 104.8, a further compression takes place of the disk spring package 104.9 until a force equilibrium is reached, at which the contact force K takes effect between the two friction elements 104.1 and 104.2.

The increase in the force exerted by the disk spring package 104.9 can in this situation be adjusted by the selection of the disk springs used. For preference comparatively soft disk springs are used, but which are already comparatively strongly pre-tensioned in the unladen initial state of the force generating device 104.7 in order to achieve the desired pre-tension force FV. This has the advantage that, if the break-loose force FV is exceeded, only a comparatively flat rise in the contact force K will take place, such that, in other words, a delimitation of the friction moment can be attained, and therefore a delimitation of the damping of the outwards rotational movement.

In this situation provision can be made for the break-loose force FV to be exceeded already with the wagon body 102 in the unladen state, so that already in this state a deflection of the contact element 104.8 takes place. This then avoids a sharp rise in the contact force if the wagon body 102 undergoes further loading. Rather, in this case a larger proportion of the weight force of the wagon body 102 is then conducted via the central support device 105 into the bogie 103.

The consequence of this is that, with the contact force rising, the friction moment damping the outwards rotational movement also rises only comparatively weakly. With an appropriate design of the disk spring package 104.9, it can be achieved, should the situation arise, that the damping friction moment (regardless of the loading of the wagon body 102) remains almost constant, which in certain application cases can be of advantage.

Likewise, provision can of course be made for the break-loose force FV not to be attained until a predeterminable loading of the wagon body 102 is reached. In this case, in the first instance, a comparatively sharp rise in the contact force K (as a function of the loading of the wagon body 102) can take place until the break-loose force FV is reached, and therefore a loading-dependent rise in the damping friction moment MR up to a specific friction moment threshold is achieved, while, after the break-loose force FV is exceeded (depending on the application situation), the delimitation of the friction moment MR described above, and a flatter rise in the friction moment MR respectively, can be attained.

In the present example, the disk spring package 104.9 is designed in such a way that the contact element 104.8, in normal operation of the vehicle 101, carries out a predeterminable excursion between a first extreme position (the shoulder 104.11 is in contact with the stop 104.13) and a second extreme position (carrier arm 104.3 is located shortly before coming in stop contact at the housing 104.10). In the direction of the height axis of the vehicle (z-direction), the contact element 104.8 in the first extreme position exerts the break-loose force FV on the carrier arm 104.3 as a maximum first force, while in the second extreme position it exerts a second force on the carrier arm 104.3. The disk spring package 104.9 is designed in such a way that the second force in the present example deviates from the first force by a maximum of 5% of the first force. It is understood, however, that with other variants of the invention a more substantial deviation of the second force from the first force is possible. In particular, deviations by up to 30% of the first force are possible.

As a result of this, a particularly favourable curve of the damping friction moment MR can be achieved from running dynamics points of view. The damping friction moment MR is then (if applicable, above a predeterminable threshold) not only largely loading-independent, but even under the effect of vertical forces of inertia, which with known designs invoke a substantial variation in the friction moment, the friction moment MR advantageously remains within close predeterminable limits.

Due to the functional separation according to the invention of the friction element carrier 104.3 and the force generating device 104.7 it is possible, on the one hand, for the first friction element, with regard to the attaining of a high friction moment damping the rotational movement, to be arranged in a favourable position far remote, in the transverse direction of the vehicle, from the axis of rotation (defined by the support device 105) of the rotational movement. A further advantage lies in the fact that the force generating device 104.7 can be optimised in a simple manner, as described above, for its primary function of force application.

The friction element carrier 104.3 can in turn be easily optimised in respect of its primary function of the most play-free possible introduction of the damping friction moment MR into the bogie 103. Accordingly, a play-free introduction of the damping friction moment MR in the present example is realised in that the carrier arm 104.3 is rigidly connected to the bolster 103.5 in the area of the connection sections 104.5 and 104.6. This can be effected by means of any desired detachable connection. For example, a simple screw connection can be provided for, wherein for preference a torsionally rigid connection is then formed for preference by means of a toothed design of the contact surfaces or the like.

Due to the arrangement of the connection sections 104.5 and 104.6 spaced apart from each other transverse to the longitudinal axis of the carrier arm 104.3, a particularly advantageous high support width of the support of the friction moment MR in the bolster 103.5 is attained, such that in the area of the connection sections 104.5 and 104.6 only comparatively low forces are to be transferred. As a result, the connection of the carrier arm 104.3 at the bolster 103.5 can be designed particularly easily.

As can be seen from FIGS. 2 and 3, the carrier arm 104.3 is designed as an essentially plate-shaped component, wherein the plane of the plate (and the main extension plane of the carrier arm 104.3 respectively) runs transverse to the height axis (z-direction). Due to the arrangement of the connection areas 104.5 and 104.6 in two corner areas of the carrier arm 104.3, and the arrangement of the first friction element 104.1 in the third corner area of the carrier arm 104.3, account is taken particularly effectively of the load circumstances upon the introduction of the friction moment MR into the bolster 103.5. Thus, on the one hand, a comparatively low bending moment about the height axis is yet present in the area of the corner carrying the first friction element 104.1, such that the small cross-section of the carrier arm 104.3 in this area is sufficient to take this without any deformation worth mentioning. With the bending moment increasing towards the connection area, with this design the cross-section and therefore the bending resistance moment also increase, such that, in addition to the advantageously high support width, an optimum utilisation of the carrier arm 104.3 is attained at every point of time without any deformation worth mentioning.

As can be seen from FIG. 2, the carrier arm 104.3, in the plan view shown, exhibits a contour which is cambered section-wise. As a result of this, among other effects, the area moment of inertia, and therefore the bending resistance moment of the carrier arm 104.3 about a bending axis (which in the present example runs parallel to the x-direction) running transverse to its longitudinal direction and parallel to its main extension plane, varies in the longitudinal direction of the carrier arm 104.3 in such a way that it decreases in accordance with a predetermined course towards the first friction element 104.1. The cross-section course of the carrier arm 104.3 is selected in such a way that the carrier arm 104.3, in actual operation with the loads to be expected about a bending axis parallel to the height axis of the vehicle, does not undergo any deformation worth mentioning, while it undergoes a desired deformation about a bending axis parallel to the longitudinal axis of the vehicle.

In the present example, the variation in the area moment of inertia of the carrier arm 104.3 is selected in such a way that a deformation of the carrier arm 104.3 to be expected in the normal operation of the vehicle essentially does not extend into the connection area 104.4. This allows for a particularly simple connection of the carrier arm 104.3 to the bolster 103.5.

Due to the rigid and therefore play-free connection of the carrier arm 104.3 to the bolster 103.5 and the bending resistance moment of the carrier arm 104.3 adapted to the curve of the bending moment about the height axis of the vehicle, the introduction of the desired friction moment MR into the bolster 103.5 at any point of time is guaranteed, and therefore also in the event of a reversal of direction of the rotational movement. In other words, if there is a reversal of direction in the rotational movement there will be no play effects worth mentioning, during which a comparatively long period of time would pass until the opposed friction moment MR comes into effect in its full amount.

It should also be noted in this context that, with other variants of the invention, the carrier arm can of course also exhibit any other desired design. For example, with especially simple variants provision can be made for an essentially trapezoid carrier arm, as is indicated in FIG. 2 by the dotted contour line 107.

Second Embodiment

FIG. 4 (in a view corresponding to FIG. 3) shows a further embodiment of a rail vehicle 201 according to the invention. The rail vehicle 201, in its basic design and functionality, corresponds to the rail vehicle 101, such that it is intended here simply to consider the differences. In particular, identical components are provided with identical reference numbers, while components of the same type are provided with reference numbers increased by the value 100. Unless indicated otherwise hereafter, reference is expressly made with regard to the properties of these components to the remarks provided heretofore.

The difference with regard to the rail vehicle 101, on the one hand, consists of the fact that, with the vehicle 201, the carrier arm 104.3 (carrying the first friction element 104.1) of the rotation impeding device 204 is secured by its connections 104.5 and 104.6 rigidly and therefore torsionally rigid about the height axis of the vehicle (z-direction) to the wagon body 202, while the second friction element 104.2 is secured to the bolster 103.5.

A further difference lies in the fact that the force generating device 204.7 comprises only a disk spring package 204.9, which is guided transversely to its longitudinal direction of main spring direction by a guide bolt 204.15, rigidly secured to the carrier arm 104.3 (which in operation plunges into a cut-out 202.1 in the wagon body 202). Accordingly, with this variant the disk spring 204.8 contacting the carrier arm forms the contact element of the force generating device 204.7.

Finally, a further difference consists of the fact that the wagon body 202 is supported in the direction of the vehicle height axis (z-direction) only by the friction elements 104.1, 104.2, while longitudinal and transverse forces are transferred between the wagon body 202 and the bolster 103.5 also via a swivel pin 205. The consequence of this is that a loading-dependent friction moment MR (damping the rotational movement between the running gear 103 and the wagon body 202) is indeed at all times imposed without the limitation described heretofore. The deformability of the carrier arm transverse to its main extension plane in this situation, however, guarantees a uniform surface pressure between the friction elements 104.1 and 104.2, with the result that, on the one hand, at all times a precisely defined friction moment MR is present, and, on the other, an advantageously uniform wear pattern of the friction elements 104.1 and 104.2 is achieved.

The present invention has been described heretofore exclusively on the basis of examples of a rail vehicle with a bogie. It is understood, however, that the invention can also be used for vehicles with any other desired types of running gear. It is further understood that the invention can be used not only in connection with rail vehicles but also in connection with any other desired vehicles.

The invention claimed is:

1. A rotation impeding device for a vehicle having a first vehicle component comprising a running gear and a second vehicle component comprising a wagon body supported thereon the rotation impeding device comprising a friction element carrier for a first friction element, wherein the friction element carrier is connectable to the running gear or the wagon body in a manner torsionally rigid about a height axis of the vehicle such that the wagon body is supported on the running gear via the friction element, wherein the wagon body is rotatable relative to the running gear under a friction-laden relative movement between the first friction element and a second friction element impeding a rotation about the height axis, a force generating device with a contact element, wherein the force generating device is connectable to the vehicle component carrying the friction element carrier in such a way that it acts, via the contact element, on the friction element carrier to generate a contact force between the first friction element and the second friction element, wherein the friction element carrier comprises at least one carrier arm with a first end area and a second end area, located at a distance thereof in the direction of a longitudinal axis of the carrier arm, wherein the carrier arm, in the first end area, comprises a connection area adapted to connect to the vehicle component carrying the friction element carrier; and the carrier arm carries the first friction element in an area located at a distance from the first end area in the direction of the longitudinal axis of the carrier arm.

2. The rotation impeding device according to claim 1, wherein the force generating device defines a break-loose force, the exceeding of which causes a deflection of the contact element, wherein the force generating device comprises a pre-tensioning device for adjusting the break-loose force.

3. The rotation impeding device according to claim 1, wherein the force generating device comprises a mechanical spring device for generating a contact force.

4. The rotation impeding device according to claim 3, wherein the spring device comprises at least one disk spring and one disk spring guide, wherein the disk spring defines a main spring direction in which the disk spring exerts a main spring force, and the disk spring guide guides the disk spring transverse to a main spring direction, the disk spring forming the contact element.

5. The rotation impeding device according to claim 1, wherein the contact element, in normal operation of the vehicle, carries out a predeterminable excursion between a first extreme position and a second extreme position, wherein the contact element, in the first extreme position, exerts a first force on the friction element carrier and, in the second extreme position, exerts a second force on the friction element carrier, the second force deviating from the first force by a maximum of 20% of the first force.

6. The rotation impeding device according to claim 1, wherein the contact element acts on the friction element carrier in the area of the first friction element;

and/or the contact element acts on the friction element carrier on a side facing away from the first friction element.

7. The rotation impeding device according to claim 1, wherein the connection area of the carrier arm comprises at least two connection sections adapted to connect to the vehicle component carrying the friction element carrier, wherein the two connection sections are spaced apart from one another transverse to the longitudinal axis of the friction element carrier.

8. The rotation impeding device according to claim 1, wherein at least one of the connection sections is adapted to be connected free of play to the vehicle component carrying the friction element carrier.

9. The rotation impeding device according to claim 1, wherein the carrier arm is designed to be of essentially triangular shape.

10. The rotation impeding device according to claim 9, wherein the connection area extends between two corner areas of the carrier arm and the first friction element is arranged in an area of a third corner of the carrier arm.

11. The rotation impeding device according to claim 1, wherein the carrier arm exhibits an area moment of inertia about an axis of inertia, the axis of inertia running transverse to a plane defined by the longitudinal axis of the carrier arm and the height axis of the vehicle, and the area moment of inertia varies in the direction of the longitudinal axis of the carrier arm wherein the area moment of inertia decreases towards the second end.

12. The rotation impeding device according to claim 11, wherein the area moment of inertia varies such that a deformation of the carrier arm to be expected in the normal operation of the vehicle essentially does not extend into the connection area.

13. The rotation impeding device according to claim 1, wherein a cross-section of the carrier arm in a cross-section plane running transverse to the longitudinal axis decreases in the direction of the longitudinal axis of the carrier arm.

14. A vehicle with a running gear, a wagon body supported thereon, and a rotation impeding device according to claim 1, wherein first friction element carrier is connected to the running gear or the wagon body, in a manner torsionally rigid about a height axis of the vehicle, such that the wagon body is supported by the first friction element on the running gear, the wagon body being rotatable relative to the running gear under a friction-laden relative movement between the first friction element and a second friction element impeding rotation about the height axis, and the force generating device being connected to the vehicle component carrying the friction element carrier.

15. The vehicle according to claim 14, wherein the friction element carrier and the force generating device are connected to the running gear.

16. The vehicle according to claim 14, wherein the running gear comprises a running gear frame and a bolster supported on the running gear frame by means of a secondary suspension unit and running in the transverse direction of the vehicle, the wagon body being supported on the bolster by means of the rotation impeding device, and the rotation impeding device being arranged in an end area of the bolster.

17. The vehicle according to claim 16, wherein the friction element carrier and the force generating device are connected to the bolster.

18. The vehicle according to claim 14, wherein the wagon body is supported on the running gear in the direction of the height axis by a bearing device defining the axis of rotation of the relative movement between the wagon body and the running gear.

19. The vehicle according to claim 18, wherein the bearing device is designed in the form of a slewing ring.

20. A rotation impeding device for a vehicle having a first vehicle component comprising a running gear and a second vehicle component comprising a wagon body supported thereon, the rotation impeding device comprising:

a friction element carrier for a first friction element, wherein the friction element carrier is connectable to the running gear or the wagon body in a manner torsionally rigid about a height axis of the vehicle such that the wagon body is supported on the running gear via the friction element, wherein the wagon body is rotatable relative to the running gear under a friction-laden relative movement between the first friction element and a second friction element impeding a rotation about the height axis; and a force generating device with a contact element, wherein the force generating device is connectable to the vehicle component carrying the friction element carrier in such a way that it acts, via the contact element, on the friction element carrier to generate a contact force between the first friction element and the second friction element, wherein the force generating device defines a break-loose force for adjusting a vehicle loading-dependent curve of a frictional moment between the first friction element and the second friction element; and wherein exceeding the break-loose force causes deflection of the contact element.

21. The rotation impeding device according to claim 20, wherein the force generating device comprises a pre-tensioning device for adjusting the break-loose force.

22. The rotation impeding device according to claim 20, wherein the contact element, in normal operation of the vehicle, carries out a predeterminable excursion between a first extreme position and a second extreme position, wherein the contact element, in the first extreme position, exerts a first force on the friction element carrier and, in the second extreme position, exerts a second force on the friction element carrier, the second force deviating from the first force by a maximum of 20% of the first force.

* * * * *

UNITED STATES PATENT AND TRADEMARK OFFICE

CERTIFICATE OF CORRECTION

PATENT NO. : 8,191,484 B2
APPLICATION NO. : 12/548096
DATED : June 5, 2012
INVENTOR(S) : Alfred Lohmann et al.

It is certified that error appears in the above-identified patent and that said Letters Patent is hereby corrected as shown below:

Column 14, Line 61, Claim 14, before "first" insert -- a --

Signed and Sealed this
Twenty-fifth Day of September, 2012

David J. Kappos

David J. Kappos
*Director of the United States Patent and Trademark Office*